United States Patent [19]

Dickakian

[11] Patent Number: 4,548,703

[45] **Date of Patent: * Oct. 22, 1985**

[54] PITCH FOR DIRECT SPINNING INTO CARBON FIBERS

[75] Inventor: Ghazi B. Dickakian, Kingwood, Tex.

[73] Assignee: E. I. Du Pont de Nemours and Company, Wilmington, Del.

[ * ] Notice: The portion of the term of this patent subsequent to Jan. 24, 2001 has been disclaimed.

[21] Appl. No.: 646,497

[22] Filed: Sep. 4, 1984

Related U.S. Application Data

[63] Continuation of Ser. No. 399,750, Jul. 19, 1982, abandoned.

[51] Int. Cl.[4] ..... C10C 3/00; D01F 9/14

[52] U.S. Cl. ..... 208/22; 208/44; 423/447.1; 423/447.2; 423/447.4

[58] Field of Search ..... 208/22, 40, 44; 423/447.1, 447.2, 447.4, 447.6, 448, 449

[56] References Cited

U.S. PATENT DOCUMENTS

| | | | |
|---|---|---|---|
| 2,066,386 | 1/1937 | Bergien | 208/41 |
| 3,928,169 | 12/1975 | Convoy | 208/22 |
| 4,184,942 | 1/1980 | Angier et al. | 208/44 |
| 4,208,267 | 6/1980 | Diefendorf et al. | 208/22 |
| 4,219,409 | 8/1980 | Dickakian | 208/22 |
| 4,271,006 | 6/1981 | Dickakian | 208/45 |
| 4,363,415 | 12/1982 | Dickakian | 208/44 |

*Primary Examiner*—D. E. Gantz
*Assistant Examiner*—Helane Myers
*Attorney, Agent, or Firm*—E. I. Du Pont de Nemours & Company

[57] ABSTRACT

A pitch suitable for carbon fiber manufacture features a pitch having a weight content of between 80 and 100 percent toluene insolubles. The pitch is derived from a deasphaltenated middle fraction of a feedstock. The pitch is characterized as being relatively free of impurities and ash. The pitch can be spun directly into carbon fibers.

7 Claims, 3 Drawing Figures

PITCH FOR DIRECT SPINNING INTO CARBON FIBERS

This application is a continuation of application Ser. No. 399,750, filed July 19, 1982, now abandoned.

FIELD OF THE INVENTION

This invention pertains to an aromatic pitch containing a high liquid crystal (optically active) fraction, and more particularly to a pitch which can be directly spun into carbon fibers.

BACKGROUND OF THE INVENTION

As is well-known, the catalytic conversion of virgin gas oils containing aromatic, naphthenic and paraffinic molecules results in the formation of a variety of distillates that have ever-increasing utility and importance in the petrochemical industry. The economic and utilitarian value, however, of the residual fractions of the cat cracking processes (also known as cat cracker bottoms) has not increased to the same extent as have the light overhead fractions. One potential use for such cat cracker bottoms is in the manufacture of carbon artifacts. As is well known, carbon artifacts have been made by pyrolyzing a wide variety of organic materials. Indeed, one carbon artifact of particularly important commercial interest is carbon fiber. Hence, particular reference is made herein to carbon fiber technology. Nevertheless, it should be appreciated that this invention has applicability to carbon artifacts in a general sense, with emphasis upon the production on shaped carbon articles in the form of filaments, yarns, films, ribbons, sheets, etc.

The use of carbon fibers for reinforcing plastic and metal matrices has gained considerable commercial acceptance. The exceptional properties of these reinforcing composite materials, such as their high strength to weight ratio, clearly offset their high preparation costs. It is generally accepted that large scale use of carbon fibers as reinforcing material would gain even greater acceptance in the marketplace, if the costs of the fibers could be substantially reduced. Thus, the formation of carbon fibers from relatively inexpensive carbonaceous pitches has received considerable attention in recent years.

Many materials containing polycondensed aromatics can be converted at early stages of carbonization to a structurally ordered optically anisotropic spherical liquid crystal called mesophase. The presence of this ordered structure prior to carbonization is considered to be fundamental in obtaining a high quality carbon fiber. Thus, one of the first requirements of a feedstock material suitable for carbon fiber production, is its ability to be converted to a highly optically anisotropic material.

In addition, suitable feedstocks for carbon artifact manufacture, and in particular carbon fiber manufacture, should have relatively low softening points and sufficient viscosity suitable for shaping and spinning into desirable articles and fibers.

Unfortunately, many carbonaceous pitches have relatively high softening points. Indeed, incipient coking frequently occurs in such materials at temperatures where they have sufficient viscosity for spinning. The presence of coke, infusible materials, and/or high softening point components, are detrimental to the fiber-making process. Thus, for example, U.S. Pat. No. 3,919,376 discloses the difficulty in deforming pitches which undergo coking and/or polymerization at the softening temperature of the pitch.

Another important characteristic of the feedstock for carbon artifact manufacture is its rate of conversion to a suitable optically anisotropic material. For example, in the above-mentioned U.S. patent, it is disclosed that 350° C. is the minimum temperature generally required to produce mesophase from a carbonaceous pitch. More importantly, however, is the fact that at least one week of heating is necessary to produce a mesophase content of about 40%, at that minimum temperature. Mesophase, of course, can be generated in shorter times by heating at higher temperatures. However, as indicated above, incipient coking and other undesirable side reactions take place at temperatures in excess of about 440° C.

In U.S. Pat. No. 4,208,267, it has been disclosed that typical graphitized carbonaceous pitches contain a separable fraction which has important physical and chemical properties. Indeed, this separable fraction exhibits a softening range and viscosity suitable for spinning. It also has the ability to be converted rapidly (at temperatures in the range generally of about 230° C. to about 400° C.) to an optically anisotropic, deformable, liquid crystalline material structure. Unfortunately, the amount of separable fraction present in well-known commercially available petroleum pitches, such as Ashland 240 and Ashland 260, to mention a few, is exceedingly low. For example, with Ashland 240, no more than about 10% of the pitch constitutes a separable fraction capable of being thermally converted to a deformable anisotropic phase.

In U.S. Pat. No. 4,184,942, it has been disclosed that the amount of the aforementioned fraction yielding an optical anisotropic pitch can be increased by heat soaking the feedstock at temperatures in the range of 350° C. to 450° C., until spherules visible under polarized light begin to appear.

In U.S. Pat. No. 4,219,404, it has been disclosed that the polycondensed aromatic oils present in isotropic graphitizable pitches are generally detrimental to the rate of formation of highly anisotropic material in such feedstocks when they are heated at elevated temperatures and that, in preparing a feedstock for carbon artifact manufacture, it is particularly advantageous to remove at least a portion of the polycondensed aromatic oils normally present in the pitch simultaneously with, or prior to, heat soaking of the pitch for converting it into a feedstock suitable in carbon artifact manufacture.

More recently, in U.S. Pat. No. 4,271,006 (June 2, 1981), a process has been disclosed for converting cat cracker bottoms to a feedstock suitable in carbon artifact manufacture. Basically, the process requires stripping cat cracker bottoms of fractions boiling below 400° C. and thereafter heat soaking the residue followed by vacuum stripping to provide a carbonaceous aromatic pitch.

Cat cracker bottoms like all other heavy aromatic residues obtained from steam cracking, fluid cracking or coal processing are composed of two components: (1) a low molecular weight oil fraction which can be distilled; and (2) an undistillable fraction of high molecular weight. This high molecular weight fraction is insoluble in paraffinic solvents such as n-heptane, isooctane, pet ether, etc. This fraction is generally called "asphaltene".

It is preferred to use an asphaltene-free feed for the production of pitches. These asphaltenes have a very high molecular weight (up to 10,000), a very high coking characteristic (coking value as high as 67.5 wt% coke yield at 550° C.), and a very high melting point (200°-250° C.).

It is desired to use an asphaltene-free cat cracker bottom. The asphaltene-free cat cracker bottom is free of ash, coke particles and other impurities. The absence of asphaltene, ash, coke particles and other organic and inorganic impurities make the cat cracker bottom distillate an ideal feed for the production of an aromatic pitch with a very high content of liquid crystals. This asphaltene-free cat cracker bottom can be prepared by two methods: (a) by a distillation process; e.g., vacuum or steam distillation; and (b) by deasphaltenation of the cat cracker bottom. The deasphaltenation can be made readily by solvent extraction with a paraffinic solvent.

In application U.S. Ser. No. 291,990 (filed Aug. 11, 1981) and assigned to a common assignee a process is described for heat soaking a deasphaltenated cat cracker bottom.

In application U.S. Ser. No. 225,060 (filed Jan. 14, 1981) and assigned to a common assignee a process is described for obtaining a feedstock with a low liquid crystal fraction by heat soaking a distillate derived from a cat cracker bottom. The pitch produced in the above application, Ser. No. 225,060 cannot be used directly for carbon fiber production. The liquid crystal fraction has to be extracted from the pitch and used for fiber production.

Whereas, application U.S. Ser. No. 225,060 teaches that all of the cat cracker bottoms can be used to obtain a pitch having low toluene insolubles (Ti), the present invention teaches the opposite, i.e. obtaining a pitch from fractions of the cat cracker bottoms which has a high Ti content (a high content of liquid crystals).

The present invention uses deasphaltenated feedstock fractions to provide a pitch having a high Ti content, and one which does not require Ti solvent extraction prior to spinning into fibers.

The deasphaltenated fractions of a feedstock in accordance with this invention is generally free of ash and impurities, and has the proper rheological properties to allow direct spinning into carbon fibers. The pitch obtained from this fraction produces fibers which have high strength and performance. For example, a deasphaltenated cat cracker bottom fraction obtained in accordance with the present invention, has virtually no coking value at 550° C. compared with a 56% standard coking value for Ashland 240. The deasphaltenated cat cracker bottom fraction is composed of 4, 5, and 6 polycondensed aromatic rings. This provides a uniform feed material which can be carefully controlled to produce a uniform product with a narrow molecular weight distribution.

SUMMARY OF THE INVENTION

The present invention pertains to a high Ti pitch for direct spinning into carbon fibers. An aromatic pitch with a very high liquid crystal fraction (80-100%) can be prepared by thermally reacting a deasphaltenated fraction of either a cat cracker bottom, steam cracker tar or a coal distillate, that are respectively rich in (4, 5 and 6); (2, 3, 4 and 5); and (3, 4, 5 and 6) aromatic rings. The various feedstocks fraction are heat soaked in a temperature range from 420° C. to 450° C. at atmospheric pressure, and then vacuum stripped to remove at least a portion of the unreacted oils at a temperature in the approximate range of from 320° C. to 440° C. at 0.1 to 100 mmHg, and preferably at greater than 400° C. at 1.0-5.0 mmHg of pressure.

More specifically, in the case of cat cracker bottoms the fraction is heat soaked at approximately 440° C. for 2-4 hours at atmospheric pressure. In the case of steam cracker tars, the fraction is heat soaked at 430° C. for approximately 4.0 hours; and in the case of coal distillate, the fraction is heat soaked at approximately 440° C. for ¼ to ½ hour. All the heat soaked materials are then vacuum stripped and spun directly into carbon fibers. The pitch of this invention is definable only in terms of deasphaltenated fractions of a feedstock and containing 4, 5 and 6 aromatic rings.

For the purposes of definition the terms "deasphaltenated feedstock" and/or "deasphaltenated middle fraction of a feedstock" shall mean: a deasphaltenated material obtained from a middle cut of a feedstock, and/or one caused to be relatively free of asphaltenes by means of obtaining a distillate portion of said feedstock which when further treated will form a precursor which can be spun into a carbon fiber and which has the following general characteristics:

(1) a relatively low coking value;

(2) a relatively low content of ash and impurities; and (3) a relatively narrow average molecular weight range.

(4) consisting of 3, 4, 5 and 6 alkyl-substituted polycondensed aromatics.

A typical weight percentage of asphaltenes in a deasphaltenated cat cracker bottom feedstock being in the range of approximately 0.0 to 1.0%.

A directly spinnable pitch of this invention has the proper rheological properties characterized as a glass transition temperature (Tg) in the approximate range of 180° C. to 250° C. at atmospheric pressure, and/or a viscosity of less than approximately 2,500 cps in a temperature of approximately 360° C. at atmospheric pressure.

It is an object of this invention to provide an improved pitch which can be directly spun into carbon fibers.

It is another object of the invention to provide a pitch for manufacturing carbon fibers which is more uniform, and which is relatively free of ash and impurities.

It is a further object of this invention to provide a pitch having high toluene insolubles, and which does not require Ti solvent extraction prior to spinning into fibers.

These and other objects of this invention will be better understood and will become more apparent with reference to the following detailed description considered in conjunction with the accompanying drawings.

DETAILED DESCRIPTION OF THE INVENTION

Figure 1:
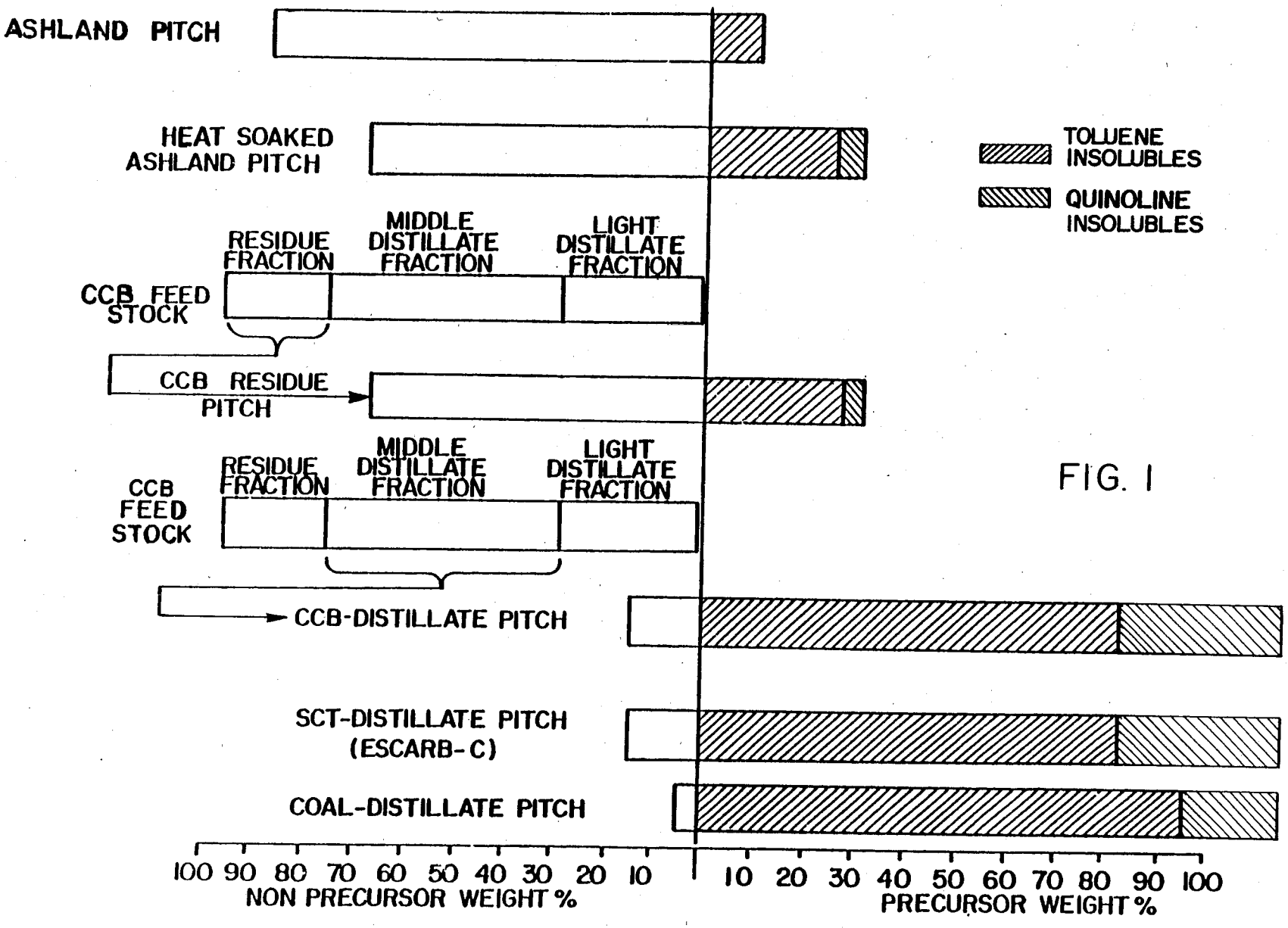
FIG. 1 is a graphical representation of deasphaltenated fractions of various feedstocks used to provide the inventive pitches for direct spinning into carbon fibers, including the deasphaltenated cat cracker bottom of this invention.

The term catalytic cracking refers to a thermal and catalytic conversion of gas oils, particularly virgin gas oils, boiling generally between 316° C. and 566° C., into lighter, more valuable products.

Cat cracker bottoms refer to that fraction of the product of the cat cracking process which boils in the range of from about 200° C. to about 550° C.

Cat cracker bottoms typically have relatively low aromaticity as compared with graphitizable isotropic carbonaceous pitches suitable in carbon artifact manufacture.

Specifications for a typical cat cracker bottom that is suitable in the present invention are given in Table 1:

TABLE 1

| | Range |
|---|---|
| Physical Characteristics | |
| Viscosity cst @ 210° F. | 1.0–10.0 |
| Ash content, wt % | 0.010–02.0 |
| Coking value (wt % @ 550° C.) | 6.0–18.0 |
| Asphaltene (n-heptane insoluble), % | 1.1–12.0 |
| Toluene insolubles (0.35μ), % | 0.010–1.0 |
| Number average mol. wt. | 220–290 |
| Elemental Analysis | |
| Carbon, % | 88.0–90.32 |
| Hydrogen, % | 7.74–7.40 |
| Oxygen, % | 0.10–0.30 |
| Sulfur, % | 1.0–4.5 |
| Chemical Analysis (proton NMR) | |
| Aromatic carbon (atom %) | 54–72 |
| Carbon/hydrogen atomic ratio | 0.90–1.0 |
| Asphaltene Analysis | |
| Number average mol. wt. | 550–750 |
| Coking value, wt % at 550° C. | 3.5–6.5 |
| Aromatic carbon (atom %) | 55–70 |
| Bureau of Mines Correlation Index | 120–140 |

Tables 2 and 3 below, illustrate the various fractions and characteristics of fractions 3 through 6 for a typical cat cracker bottom:

TABLE 2

| Fractions | Boiling Point, °C./760 mm Mercury | Wt % |
|---|---|---|
| Distillate Fraction 1 | 271–400 | 10.0 |
| Distillate Fraction 2 | 400–427 | 23.8 |
| Distillate Fraction 3 | 454 | 13.3 |
| Distillate Fraction 4 | 454–471 | 11.7 |
| Distillate Fraction 5 | 471–488 | 13.4 |
| Distillate Fraction 6 | 488 | 10.0 |
| (Residue) | 510+ | 17.5 |

The boiling point corrected to atmospheric pressure and weight percent breakdown of fractions 3–6 is given in Table 3 below:

TABLE 3

Chemical and Physical Characteristics of Distillate Fractions 3–6 (427–510° C.) of Cat Cracker Bottoms

| | |
|---|---|
| Ash (wt %) | 0.0001 |
| Asphaltene (n-heptane insolubles), % | nil |
| Coking value (coke yield at 550° C.) | nil |
| Average mol wt % (MS-method) | 260 |
| Carbon/hydrogen atomic ratio | 0.89 |
| Aromaticity (aromatic carbon atom % by NMR) | 66 |
| Aromatic Ring Distribution (MS-method) | |
| 1 ring (%) | 1.5 |
| 2 ring (%) | 13.0 |
| 3 ring (%) | 31.0 |
| 4 ring (%) | 44.0 |
| 5 ring (%) | 6.4 |
| 6+ ring (%) | 1.0 |
| Aromatic Ring Composition (by MS-method) | |
| Rings with carbon and hydrogen (%) | 63 |
| Rings with carbon, hydrogen and oxygen (%) | 2 |
| Rings with carbon, hydrogen and sulfur (%) | 33 |

Mass Spectrometric Analysis of the Distillate Fractions 3–6 (427–510° C.) of Cat Cracker Residue Indicated the Presence of the Following Main Polycondensed Aromatics

| Molecular Formula | Typical Name | Weight (%) (Average Molecular Weight) |
|---|---|---|
| $C_nH_{2n-16}$ | Acenophthenes | 1.54 (218) |
| $C_nH_{2n-18}$ | Phenanthrenes | 8.95 (243) |
| $C_nH_{2n-20}$ | Naphtheno-Phenanthrene | 9.78 (254) |
| $C_nH_{2n-22}$ | Pyrenes | 15.4 (253) |
| $C_nH_{2n-24}$ | Chrysenes | 8.70 (265) |
| $C_nH_{2n-26}$ | Cholanthrenes | 2.9 (283) |
| $C_nH_{2n-14}S$ | Benzopyrene | 1.0 (295) |
| $C_nH_{2n-16}S$ | Indothiophenes | 1.45 (280) |
| $C_nH_{2n-18}S$ | Naphthotiophene | 4.7 (249) |
| $C_nH_{2n-20}S$ | Acenophthylene Thiophenes | 4.0 (273) |
| $C_nH_{2n-22}S$ | Anthraceno-Thiophenes | 3.8 (261) |
| $C_nH_{2n-24}S$ | Naphteno-Phenanthreno Thiophenes | 9.9 (271) |
| $C_nH_{2n-26}S$ | Pyrenothiophenes | 1.20 (295) |
| $C_nH_{2n-28}S$ | Chryseno-Thiophenes | 0.82 (295) |
| $C_nH_{2n-30}S$ | | |

In the process of the present invention, the cat cracker bottoms are fractionally distilled by heating the cat cracker bottom to elevated temperatures and reduced pressures, for example, by heating to temperatures in the range of 200° C. to 300° C. at pressures ranging from about 250 to 500 millimeters of mercury. Basically, the cat cracker bottom is separated into at least a single distillate having a boiling point at 760 mm mercury in the range of from about 250° C. to about 530° C., and the residue being the fraction not distillable at temperatures up to 530° C., at a pressure of about 350 to 450 millimeters of mercury. In a particularly preferred embodiment of the present invention, the distillate fraction of the cat cracking bottom which is employed in forming a suitable carbonaceous pitch for carbon artifact manufacture is that fraction boiling in the approximate range of about 450° C. to about 510° C. at 760 mm of mercury. The desired cat cracker bottom fraction can also be obtained by other commercially known separation methods such as steam distillation, flash stripping or by using a thin film evaporator.

To produce a pitch with a high fraction of anisotropic liquid crystal, the cat cracker bottom fraction is heat soaked at temperatures in the approximate range of 420° C. to 450° C. at atmospheric pressure. In general, heat soaking is conducted for times ranging from 2 hours to about 4 hours. In the practice of the present invention, it is particularly preferred that heat soaking be done in an atmosphere such as nitrogen, or alternatively in a hydrogen atmosphere.

When the heat soaking is completed, the reaction mixture is then subjected to a reduced pressure at a liquid temperature between 320°–440° C., and most preferably at 400°–430° C., to remove from the mixture at least part of the distillable unreacted oils. Preferably, all of the unreacted oils are removed in order to concentrate and increase the anisotropic liquid crystal fraction in the final pitch product. The use of a high liquid temperature, e.g., 400°-430° C., is very desirable. The high liquid temperature helps to remove the distillable unreacted oils, which if left in the final pitch product tend to dilute and reduce the liquid crystal content of the pitch.

Optionally, the heat soaked mixture can be purged with a gas such as nitrogen in order to accelerate the removal of the unreacted oils.

The resultant pitch produced by the abovedescribed method has a low melting point (as defined by our DSC method) (190°-230° C.), has very high aromaticity (85-90% of aromatic carbon atoms by carbon NMR method) and contains a high anisotropic liquid crystal fraction (80-100% by polarized light microscopy). The pitch composition is defined readily by using solvent analysis, wherein the content insolubles in toluene at room temperature and the content insolubles in quinoline at 75° C. are determined. The toluene insoluble (Ti) fraction in the pitch can be used to give a measure of the liquid crystal content in the pitch. One of the objectives of this invention is to transform the cat cracker bottom distillate fraction into a pitch with a very high content of toleune insolubles (80-100%), as well as a high content of quinoline insolubles (at least 15%, between 15 and 50%) and which can be spun directly into carbon fibers, as shown in FIG. 1.

For a better understanding of the treatment particulars used to convert these distillates into pitch, please refer to U.S. application, Ser. No. 346,623 filed on Feb. 8, 1982, which is meant to be incorporated herein by way of reference.

The present invention distinguishes over the invention of this referenced application most particularly in the heat soaking step of the process.

The pitches of all these inventions are definable only in terms of deasphaltenated fractions of a feedstock (FIG. 1).

Table 4 below, summarizes the heat soaking conditions for a variety of deasphaltenated feedstocks, and the resultant characteristics of each pitch:

TABLE 4

| | The Production of Directly Spinnable Pitch from Distillates of CCB, SCT and Coal | | | | | | | | |
|---|---|---|---|---|---|---|---|---|---|
| FEED | CCB-DISTILLATE | | | | | SCT DISTILLATE | | COAL DISTILLATE | |
| Example | 1 | 2 | 3 | 4 | 5 | 6 | 7 | 8 | 9 |
| Heat-Soaking Process Conditions | | | | | | | | | |
| Temp (°C.) | 440 | 440 | 440 | 450 | 440 | 430 | 430 | 430 | 440 |
| Time (hrs) | 2 | 3 | 4 | 2 | 3½ | 40 | 40 | ½ | ¼ |
| Pressure: atmosphere | | | | | | | | | |
| Pitch Composition | | | | | | | | | |
| TiSep (%) | 84.5 | 86.8 | 91.7 | 89.9 | 94.4 | 86.0 | 89.1 | 97.0 | 97.5 |
| QiASTM (%) | 17.3 | 25.4 | 45.9 | 27.1 | 32.4 | 0.4 | 32.8 | 14.0 | 1.7 |
| RPI (%) | 39.1 | 50.0 | — | 49.9 | 66.0 | — | — | — | — |
| Glass Transition Temp (°C.) | | | | | | | | | |
| of total pitch | 194 | 219 | 228 | 214 | 207 | 193 | — | 183 | — |
| of TiSep | 235 | 235 | 244 | 239 | 242 | 245 | — | 210 | — |
| Elemental Analysis | | | | | | | | | |
| Carbon (%) | 93.99 | — | 93.48 | 92.89 | — | — | — | 89.88 | — |
| Hydrogen (%) | 4.32 | — | 4.09 | 4.14 | — | — | — | 5.37 | — |
| Sulfur (%) | 1.5 | — | — | — | — | — | — | 0.41 | — |
| Oxygen (%) | — | — | — | — | — | — | — | 2.91 | — |
| Nitrogen (%) | — | — | — | — | — | — | — | 1.59 | — |
| Aromaticity | | | | | | | | | |
| Aromatic carbon atom (%) | 88 | — | — | — | — | — | — | — | — |
| C/H atomic ratio | 1.80 | — | 1.90 | 1.87 | — | — | — | 1.59 | — |
| Viscosity (cps) | | | | | | | | | |
| @ 310° C. | 1393 | — | — | — | — | — | — | — | — |
| @ 320° C. | 400 | — | — | — | — | — | — | — | — |
| @ 330° C. | 131 | — | — | 435 | 5229 | — | — | — | — |
| @ 340° C. | — | — | 4352 | 218 | 1523 | — | — | — | — |
| @ 350° C. | — | — | 1409 | — | 696 | — | — | — | — |

Figure 2:
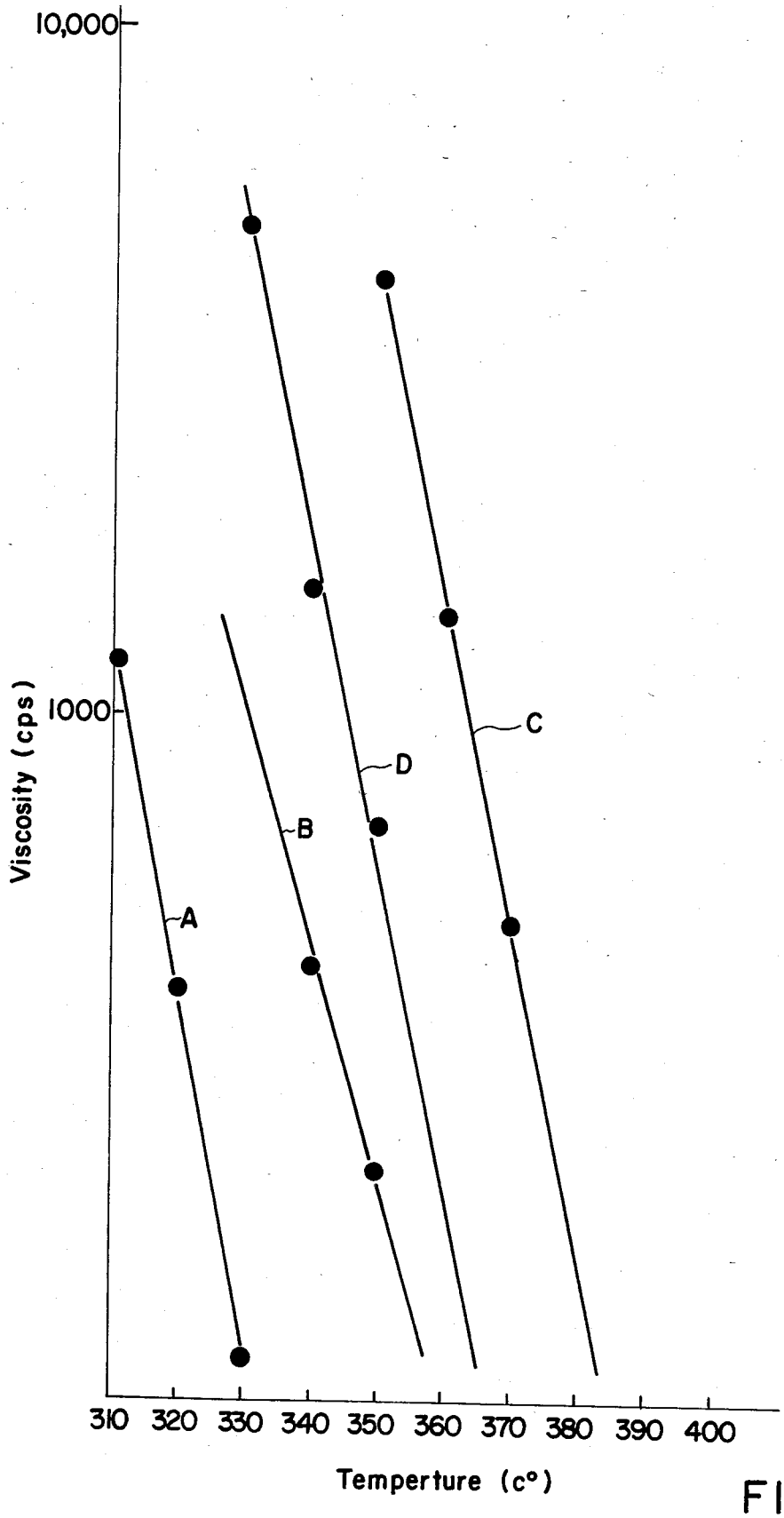
FIG. 2 shows a graph of viscosity vs. temperature for a number of pitches made from deasphaltenated cat cracker bottom distillates.

The rehology of pitches used for direct spinning is of great importance to obtain good spinnability. It is desired to have pitches with low viscosity at the spinning temperature which is preferably below around 400° C., in order to avoid pitch cracking and volatilization which could lead to serious foaming of the fiber and substantial reduction in the fiber strength. The pitch for direct spinning is also desired to be less sensitive to heat, i.e. does not change its viscosity too much when changing temperature. The sensitivity of the pitch to temperature variation can be determined from viscosity-temperature curves. This relationship for several pitches designated A, B, C, and D is shown in FIG. 2.

Differential Scanning Calorimetry (DSC) is used to obtain information on glass transition and softening characteristics of pitches. An OMINITHERM Corp. DSC Model (QC25) is used to obtain the glass transition (Tg) data. The method comprises heating a small sample of the pitch in the DSC pan, allowed to cool and the DSC trace was then obtained by heating at the rate of 10° C./min under nitrogen (30 cc/min). From the DSC trace three DSC data points are determined; the onset of Tg (Ti), the termination of Tg (Tf) and the Tg point which is at the midway between the Ti and Tf point. It has been reported that there is a relationship between the Tg of the pitch and its softening point as determined by the traditional method such as the ring and ball method. The softening point is higher by around 60° C. than the Tg.

The DSC data of CCB-distillate pitches is presented in table 5 below:

TABLE 5

| Pitch | A | E | C | B | D |
|---|---|---|---|---|---|
| DSC data | | | | | |
| Ti (onset of Tg) | 166 | 185 | 193 | 179 | 166 |
| Tg (glass transition) | 194 | 219 | 228 | 214 | 207 |
| Tf (termination of Tg) | 228 | 258 | 269 | 253 | 251 |

Figure 3:
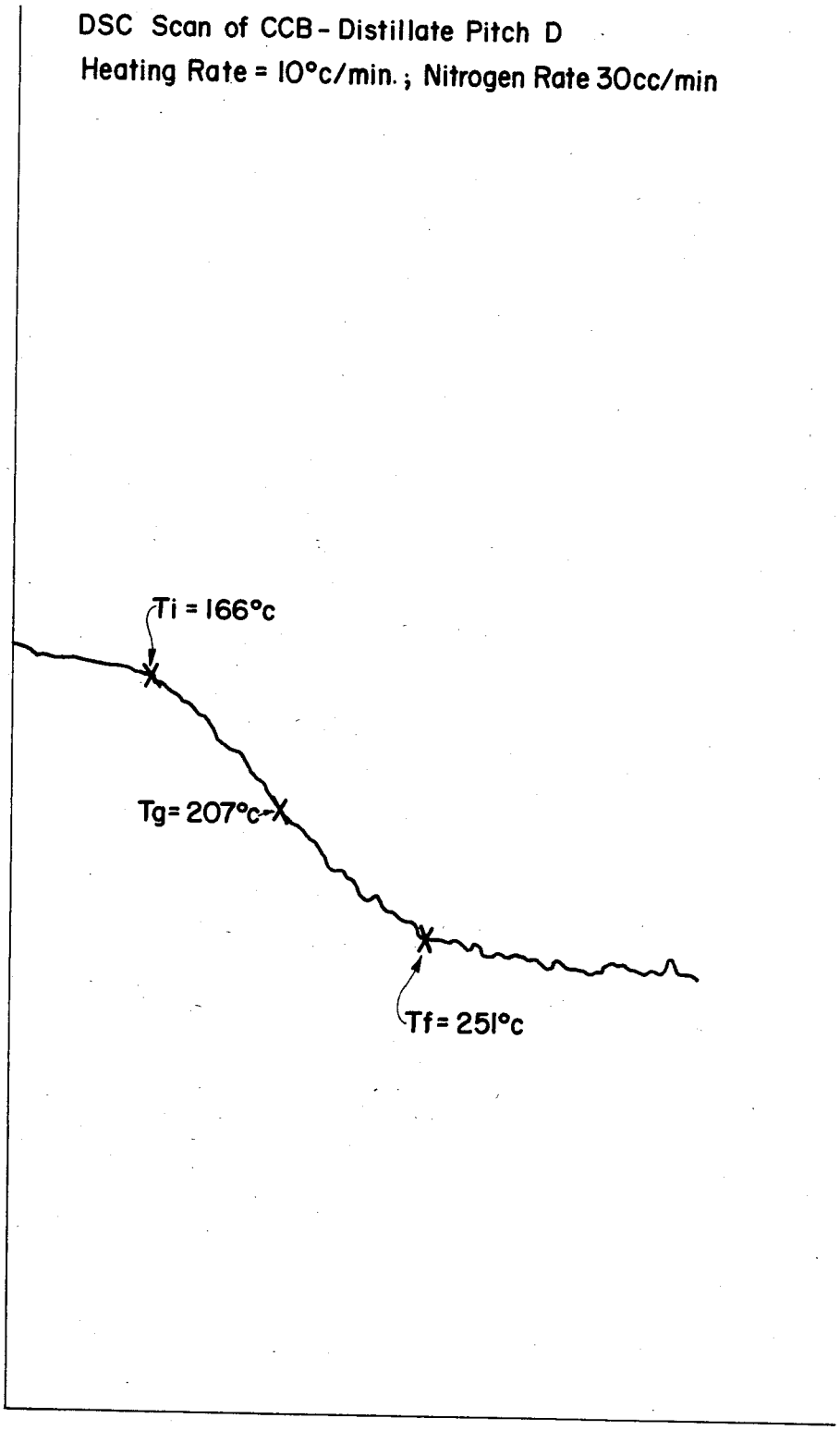
FIG. 3 depicts a graph of a glass transition temperature scan for one of the pitches shown in FIG. 2.

The DSC scan of CCB-distillate pitch D is shown in FIG. 3.

Having thus described this invention, what is desired to be protected by Letters Patent is presented in the following appended claims.

What is claimed is:

1. A pitch suitable for carbon fiber manufacture which can be spun directly into pitch fibers, comprising approximately by weight content between 80 and 100 percent toluene insolubles and approximately greater than 15 percent quinoline insolubles, said pitch having been derived, by heat soaking followed by vacuum stripping, from a substantially deasphaltenated fraction of a cat cracker bottom feedstock which is rich in 4, 5 and 6 polycondensed aromatic rings, and wherein said pitch is further characterized as being relatively free of impurities and ash.

2. A pitch suitable for carbon fiber manufacture which can be spun directly into pitch fibers, comprising approximately by weight content between 80 and 100 percent toluene insolubles, said pitch having been derived, by heat soaking followed by vacuum stripping, from a substantially deasphaltenated fraction of a cat cracker bottom feedstock which is rich in 4, 5 and 6 polycondensed aromatic rings, and wherein said pitch is further characterized as having approximately between 15 and 50 percent quinoline insolubles by weight.

3. A process for spinning pitch directly into pitch fibers, comprising the steps of:

(a) containing a substantially deasphaltenated middle fraction of a cat cracker bottom feedstock which is rich in 4, 5 and 6 polycondensed aromatic rings;

(b) subjecting said middle fraction to heat soaking to produce a pitch intermediate;

(c) removing at least a portion of said pitch intermediate to produce a pitch comprising approximately between 80 and 100 percent by weight of toluene insolubles and at least 15 percent quinoline insolubles; and (d) spinning said pitch directly into pitch fibers.

4. The process of claim 3, wherein said thermal reaction includes heat soaking said fraction at a temperature in an approximate range of between 420° and 450° C. for a duration of from 2 to 4 hours at atmospheric pressure.

5. A pitch suitable for carbon artifact manufacture made by the process including the steps of:

(a) distilling a cat cracker bottom feedstock to obtain a substantially deasphaltenated middle fraction rich in 4, 5 and 6 polycondensed aromatic rings;

(b) heat soaking said middle fraction; and (c) vacuum stripping said heat soaked middle fraction to remove oils therefrom, resulting in a pitch comprising 80 to 100 percent by weight of toluene insolubles and at least 15 percent quinoline insolubles; and (d) spinning said pitch directly into pitch fibers.

6. The pitch of claim 5, wherein said pitch comprises approximately between 15 and 50 percent by weight quinoline insolubles.

7. The pitch of claim 5, wherein said pitch comprises approximately 1 to 60 percent by weight pyridine insolubles.

* * * * *